US010279949B2

(12) United States Patent
Maurello

(10) Patent No.: US 10,279,949 B2
(45) Date of Patent: May 7, 2019

(54) METHODS AND SYSTEMS FOR DISPENSING HEATED WATER-INSOLUBLE LIQUIDS

(71) Applicant: Rocco C. Maurello, Las Vegas, NV (US)

(72) Inventor: Rocco C. Maurello, Las Vegas, NV (US)

( * ) Notice: Subject to any disclaimer, the term of this patent is extended or adjusted under 35 U.S.C. 154(b) by 0 days.

(21) Appl. No.: 15/960,351

(22) Filed: Apr. 23, 2018

(65) Prior Publication Data

US 2018/0305063 A1 Oct. 25, 2018

Related U.S. Application Data

(60) Provisional application No. 62/602,395, filed on Apr. 21, 2017.

(51) Int. Cl.

| | |
|---|---|
| ***B65D 1/02*** | (2006.01) |
| ***B65D 85/72*** | (2006.01) |
| ***B65D 47/06*** | (2006.01) |
| ***A47G 19/00*** | (2006.01) |
| ***A47G 19/26*** | (2006.01) |
| ***A47G 19/12*** | (2006.01) |
| *B65D 25/28* | (2006.01) |

(52) U.S. Cl.

CPC ..... *B65D 1/0238* (2013.01); *A47G 19/00* (2013.01); *A47G 19/26* (2013.01); *B65D 47/065* (2013.01); *B65D 85/72* (2013.01); *A47G 2019/122* (2013.01); *B65D 25/2811* (2013.01)

(58) Field of Classification Search

CPC ..... B65D 1/0238; B65D 85/72; B65D 47/065

USPC ..... 222/146.5, 465.1, 548, 572; 215/382, 215/383

See application file for complete search history.

(56) References Cited

U.S. PATENT DOCUMENTS

| | | | | | |
|---|---|---|---|---|---|
| 2,403,691 | A * | 7/1946 | States | A47J 31/46 | 215/260 |
| 2,566,035 | A * | 8/1951 | Schlumbohm | A47J 36/14 | 222/465.1 |
| 3,070,250 | A * | 12/1962 | Bramming | A47J 41/0022 | 215/358 |
| 4,618,066 | A * | 10/1986 | Vail | A47J 41/00 | 206/217 |
| 4,721,214 | A * | 1/1988 | Wandel | A47G 19/127 | 215/13.1 |
| 5,072,858 | A * | 12/1991 | Brashier | A47G 19/12 | 222/144.5 |

(Continued)

*Primary Examiner* — Vishal Pancholi

(74) *Attorney, Agent, or Firm* — Tanzina Chowdhury

(57) ABSTRACT

A container for dispensing a liquid water-insoluble edible fat includes a main body portion containing a body volume and a fill sub-volume, less than the body volume, within a first region of the main body portion. The container includes a pouring portion configured to direct a flow of the liquid water-insoluble edible fat out of the container when the container is tilted off of a vertical axis, and a neck portion connecting the main body portion to the pouring portion. The neck portion has a neck width less than a width of the main body portion in a first direction, the main body volume is configured to further include a catch sub-volume within a second region of the main body portion extending beyond the neck width in the first direction, the second region is different than the first region, and the catch sub-volume is substantially equal to the fill sub-volume.

20 Claims, 9 Drawing Sheets

(56) References Cited

U.S. PATENT DOCUMENTS

| | | | | | |
|---|---|---|---|---|---|
| 5,265,767 | A * | 11/1993 | Gustafson | A47G 19/12 | 222/144.5 |
| 5,968,618 | A * | 10/1999 | Miller | A47G 19/127 | 215/13.1 |
| 7,091,455 | B2 * | 8/2006 | Fung | A47J 27/2105 | 219/429 |
| 9,027,464 | B1 * | 5/2015 | Al-Jamaan | A47G 19/14 | 99/279 |
| 2008/0128320 | A1 * | 6/2008 | Woersdoerfer | A47J 41/0094 | 206/769 |
| 2008/0274246 | A1 * | 11/2008 | Glucksman | A47J 31/20 | 426/425 |
| 2016/0029848 | A1 * | 2/2016 | Tuan | A47J 45/065 | 220/764 |

* cited by examiner

METHODS AND SYSTEMS FOR DISPENSING HEATED WATER-INSOLUBLE LIQUIDS

CROSS REFERENCE TO RELATED APPLICATIONS

This application claims the benefit of and priority to U.S. Provisional Patent Application Ser. No. 62/602,395, filed Apr. 21, 2017, which is incorporated herein by reference in its entireties.

BACKGROUND

The field of the disclosure relates generally to edible liquid food dispensing containers, and more particularly, to liquid food dispensing containers having at least two mutually insoluble liquids of different respective densities.

Many cooked edible food items (e.g., meat, fish, vegetables, etc.) are coated with a layer of edible fat or oil (e.g., butter, margarines, oils such as coconut, corn, olive, etc., collectively referred to herein as "butters"). However, most butters are in solid form at room temperature, and must be melted in order to butter the respective food items. The coating process using melted butters is therefore referred to herein as "buttering." In some cases, uncooked edible food items are also buttered. The process of buttering the food items is typically inconvenient, time-consuming, and messy. Where large quantities of food are involved, and/or when a significant number of persons come into contact with the food (e.g., restaurants open to the public), additional numerous problems exist with respect to sanitary conditions, labor and time resources, cross-contamination of food products (which can be a particular concern where food allergies exist), and logistics. Such problems become significantly more pronounced where particularly large quantities food are subject to buttering for and/or by large number of people, such as occurs with county fairs, autumn corn harvests, public fish boils, "lobster fests," etc.

Additionally, even in the case of relatively lower quantities of food and limited numbers of persons, the circumstances of the consuming the relevant food items can also make buttering difficult. For example, a picnic or similar outdoor activity typically will not allow consumers access to microwave or stove availability to melt the butters, which, even when pre-melted, often will re-solidify by the time the relevant meal commences. Solidified butters in a common container bill often be scooped by utensils of multiple persons, which utensils may have already been used for eating (a sanitary problem) or for scooping other food items (a cross-contamination or sanitary problem). It is fairly common, for example, for persons to share a solid stick of butter in order to butter corn on the cob, a process which is also time-consuming, particularly in the case of larger numbers of people. Additionally, it is also somewhat common for multiple people to share a community ball of melted butters for dipping individual pieces of meat, lobster, etc., with the same utensil that the individual persons use for eating the respective food item (sometimes referred to as "double dipping", which can be unsanitary).

Some known solutions to the problems described above include methods of placing smaller quantities of butters on a serving dish or eating plate prior to potential contamination from other food items or individuals. This solution, however, is known to distribute the butters unevenly across the food item (e.g., an ear of corn), and also result in a significant amount of food waste of the unused/undistributed butters. To mitigate this problem, special dishes have been created to conform to the general shape of the food item, but this solution can be costly, difficult to reuse, and inconvenient to the consumers who are required to provide several different plates for each respective type of food item. Other known solutions include coating brushes, which may be effective to more evenly distribute the butters, but are nevertheless subject to the sanitary and cross-contamination problems noted above, particularly where a consumer desires one or more subsequent butterings of the food item during consumption.

Other known solutions include chafing dishes with a portable fuel source, but chafing dishes are often inconvenient for portability, and sometimes banned from outdoor activities. Chafing dishes are also known to use water in the heating process, but only in a separate container or pan from the butter to provide a lower boiling temperature that will prevent the butter from reaching its higher boiling point. Electric butter melters are also known, including some portable, battery-operated models, but these electric melted butters can also be expensive, and typically are effective only for one type of butter (i.e., margarine or actual butter), and may be difficult to clean for reuse, and are also known to have a limited lifespan of operation. Additionally, the electric butter melters often spray the respective melted butter at only one level of thickness, making the process time-consuming when the density of the spray is below, or over-buttering the food item if the spray density is high, making it difficult to adjust the amount of buttering to the consumers desired taste or for health concerns.

Additionally, for large events or venues, commercial-size butter melters are conventionally known, but these commercial-size devices are designed for only large-scale use. These devices are not generally portable, and are typically constructed from stainless steel and other heavy components.

Accordingly, it is desirable to provide a simple and inexpensive apparatus that conveniently melts butter, maintains the melted butters in their liquefied state, may be easily cleaned for reuse, and which allows a consumer to adjust the buttering level according to desired taste or health concerns. Additionally, it is also desirable to provide such a solution that is scalable for large buttering operations.

BRIEF SUMMARY

In an embodiment, a container for dispensing at least one liquid water-insoluble edible fat includes a main body portion containing therein a body volume and a fill sub-volume within a first region of the main body portion. The fill sub-volume is less than the body volume. The container further includes a pouring portion configured to direct a flow of the at least one liquid water-insoluble edible fat out of the container when the container is tilted off of a vertical axis, and a neck portion connecting the main body portion to the pouring portion. The neck portion has a neck width less than a width of the main body portion in a first direction, the main body volume is configured to further include a catch sub-volume within a second region of the main body portion extending beyond the neck width in the first direction, the second region is different than the first region, and the catch sub-volume is substantially equal to the fill sub-volume.

In an embodiment, a method for liquefying and dispensing at least one water-insoluble edible fat is provided. The method includes steps of introducing a volume of water into a first portion of container, adding into the container the at least one water-insoluble edible fat in solid form, and heating the volume of water to a temperature sufficient to melt the at least one water-insoluble edible fat. The method further includes a step of tilting, after step of heating, the container from a vertical position to pour out of the container a liquefied quantity of the at least one water-insoluble edible fat. The method further includes a step of catching, during the step of tilting, the volume of water within a second portion of the container, smaller than the first portion, configured to prevent the volume of water from exiting the container when the container is tilted to a horizontal position perpendicular to the vertical position.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
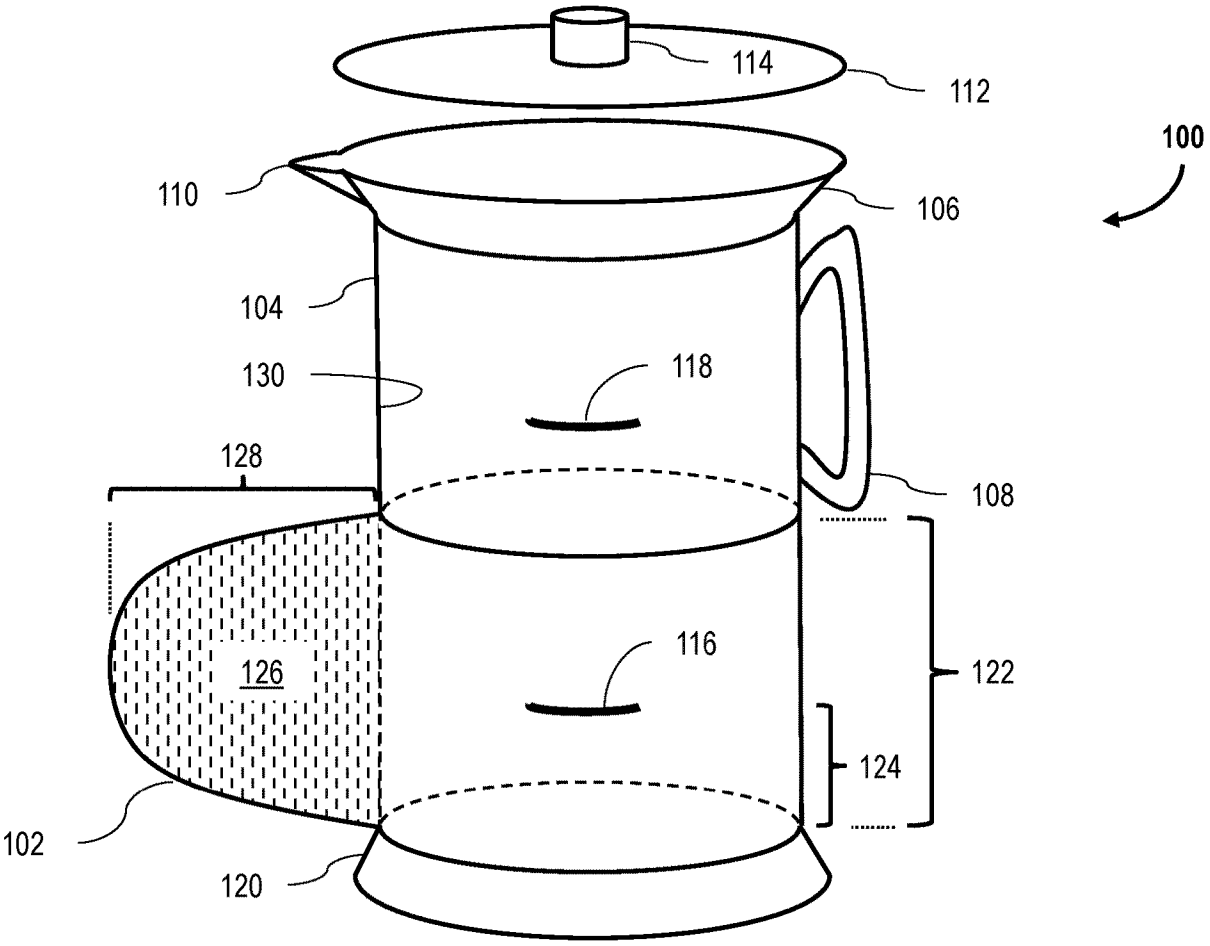
FIG. 1 depicts a sectional view an exemplary dispensing container, according to an embodiment.

Unless otherwise indicated, the drawings provided herein are meant to illustrate features of embodiments of this disclosure. These features are believed to be applicable in a wide variety of systems including one or more embodiments of this disclosure. As such, the drawings are not meant to include all conventional features known by those of ordinary skill in the art to be required for the practice of the embodiments disclosed herein.

DETAILED DESCRIPTION

In the following specification and claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

In the following description, like reference characters among the several drawings are intended to designate like or corresponding parts throughout the several views shown in the drawings. The person of ordinary skill in the art will further understand that terms such as "top," "bottom," "outward," "outer," "inward," "inner," "forward," "rearward," and the like, are used as a matter of convenience, to describe the respective relationship between different elements and/or portions of elements, and are not to be construed as limiting.

The following description features systems and methods regarding a reusable dispenser for conveniently melting edible butters for use with edible food items, maintaining the edible butters in a liquefied state for substantial duration, dispensing the liquefied butters in a controllable manner, while allowing for easy portability of the dispenser and liquefied butters.

In the exemplary embodiment, each of the following melting and dispensing systems and methods may be implemented individually, or in combination with one or more of the other techniques or processes described herein. In some embodiments, these several techniques and processes may be implemented simultaneously, in succession, or in a reverse order from steps described for the exemplary embodiment. These advantageous systems and methods are described further below with respect to the several drawings.

FIG. 1 depicts a sectional view an exemplary dispensing container 100. Container 100 includes a main body portion 102, a neck portion 104, and a pouring portion 106. As illustrated in FIG. 1, container 100 is depicted as disposing main body portion 102 on the "bottom" and pouring portion 106 on the "top," with neck portion 104 connecting main body portion 102 to pouring portion 106. As explained further below, in the exemplary embodiment, both of main body portion 102 and pouring portion 106 are wider than neck portion 104 in at least one direction.

Optionally, container 100 includes a handle 108 disposed along neck portion 104. In some embodiments, handle 108 may be disposed in whole or in part along main body portion 102 and/or pouring portion 106. Pouring portion 106 optionally includes a directional lip 110, and a removable lid 112 having a lid nob 114. In some embodiments, removable lid 112 is configured such that contents within container 100 are sealed securely therein when lid 112 is fully engaged, such as by a snap-locking connection (i.e., lid 112 will have at least one outer dimension smaller than a corresponding inner dimension of pouring portion 106) or a twist-and-seal connection with pouring portion 106. Lid nob 114 thus provides a convenient means for easy lifting and/or twisting/untwisting of removable lid 112 from pouring portion 106. In at least one embodiment, removable lid 112 is configured for a plurality of secure rotational positions (not shown) with respect to pouring portion 106 and the twist-and-seal connection, including at least one position where the contents of container 100 are fully prevented from leaking or spilling from container 100, and at least one other position that allows the contents of container 102 eggs container only from directional lip 110. Lid 112 also serves to shield the internal contents of container 100 from external debris, insects, etc.

In some embodiments, container 100 is formed of a transparent material, such as glass or plastic, and optionally includes a fill indicator 116 visible along main body portion 102. In this example, fill indicator 116 will allow the user of container 100 to view when a first liquid (e.g., water, described below with respect to FIGS. 2A-D), within container 100 reaches the height of fill indicator 116. In other embodiments, container 100 is formed of a nontransparent material, plastic or glass, or may also be stainless steel or another metal (e.g. coated aluminum, etc.), and fill indicator 116 may be a temperature sensitive coating or label that changes color when a heated liquid (water, for example, described below) reaches the height of fill indicator 116. In at least one embodiment, container 100 is not transparent, and fill indicator 116 is a transparent window that will allow a user to view when one or more of the liquid contents of container 100 reaches the height of fill indicator 116. Fill indicator 116 may also include one or both of a hydrophilic and hydrophobic substance. In an embodiment, container 100 includes one or more pouring indicators 118. In the exemplary embodiment, pouring indicators 118 are similar to fill indicator 116, but are located "above" fill indicator 116, and may be used allow easy viewing of one or more butter-to-water ratios.

In some embodiments, container 100 is formed of a microwave-safe material. In at least one embodiment, the material(s) of container 100 include a double-walled vacuum insulation body, which may be metal, glass, plastic, or a combination thereof. In the exemplary embodiment, container 100 is illustrated in FIG. 1 as being substantially unitary construction. In some embodiments, container 100 is formed of several distinct portions that are welded, glued, screwed, snap-locked together, and/or a combination thereof. In at least one embodiment, two or more of main body portion 102, neck portion 104, and pouring portion 106 include at least one threaded circular opening (not shown) with respect to the adjacent portion, allowing for the disassembly of container 100, such that container 100 may be more easily cleaned after use.

In an exemplary embodiment, container 100 further includes a base portion 120 disposed at the "bottom" of main body portion 102, to provide additional stability to container 100 against undesired movement when not in use. In the exemplary embodiment, base portion 120 is a substantially flat elevating plate. In other embodiments, base portion 120 includes a plurality of three or more stabilizers distributed proximate an outer dimension (not numbered) of the bottom of main body portion 120.

In the exemplary embodiment, main body portion 102 encloses therein a body volume 122 below neck portion 104. Body volume 122 includes a fill sub-volume 124 and a catch sub-volume 126. Fill sub-volume 124 represents the portion of body volume 122 below fill indicator 116, and catch sub-volume 126 represents the portion of body volume 122 that is contained within a forward sub-portion 128 of main body portion 102 that extends beyond an outer dimension 130 of neck portion 104 with respect to handle 108. In the embodiment illustrated in FIG. 1, handle 108 may be considered as being disposed at the "rearward" direction of container 100. In this example, directional lip 110 may also be figuratively referred to as being in the "forward" or "front" direction of container 100 with respect to handle 108.

In an exemplary embodiment, container 100 is configured to easily fit and accommodate therein at least one standard size stick of butter (i.e., in the United States, approximately 1.5×1.5×3.25 inches) within neck portion 104 and main body portion 102 when container 100 includes both the butter and a desired volume of water (described below with respect to FIG. 2). That is, in the exemplary embodiment, an internal width (or diameter, if cylindrically-shaped) of neck portion 104 is approximately 2 inches or greater. In the exemplary embodiment, neck portion 104 and pouring portion 106 are substantially cylindrical in shape. As depicted in FIG. 1, main body portion 102 integrally joins with neck portion 104 at an abrupt angle, however, main body portion 102 and neck portion 104 may connect at a smooth contoured shape (e.g., container 500, FIG. 5, below) without departing from the scope of the principles described with respect to this embodiment. Similarly, other dimensions of container 100 may vary with respect to a central axis (not shown) thereof, but also without departing from the scope of these embodiments.

An exemplary operation of dispensing container 100 is described below with respect to FIGS. 2A-D and 3. FIGS. 2A-D depict an operational series 200 of dispensing container 100, FIG. 1. FIG. 3 is a flow diagram of an exemplary melting and dispensing process 300 for container 100, and according to the operational series 200 illustrated in FIGS. 2A-D.

Figure 2A:
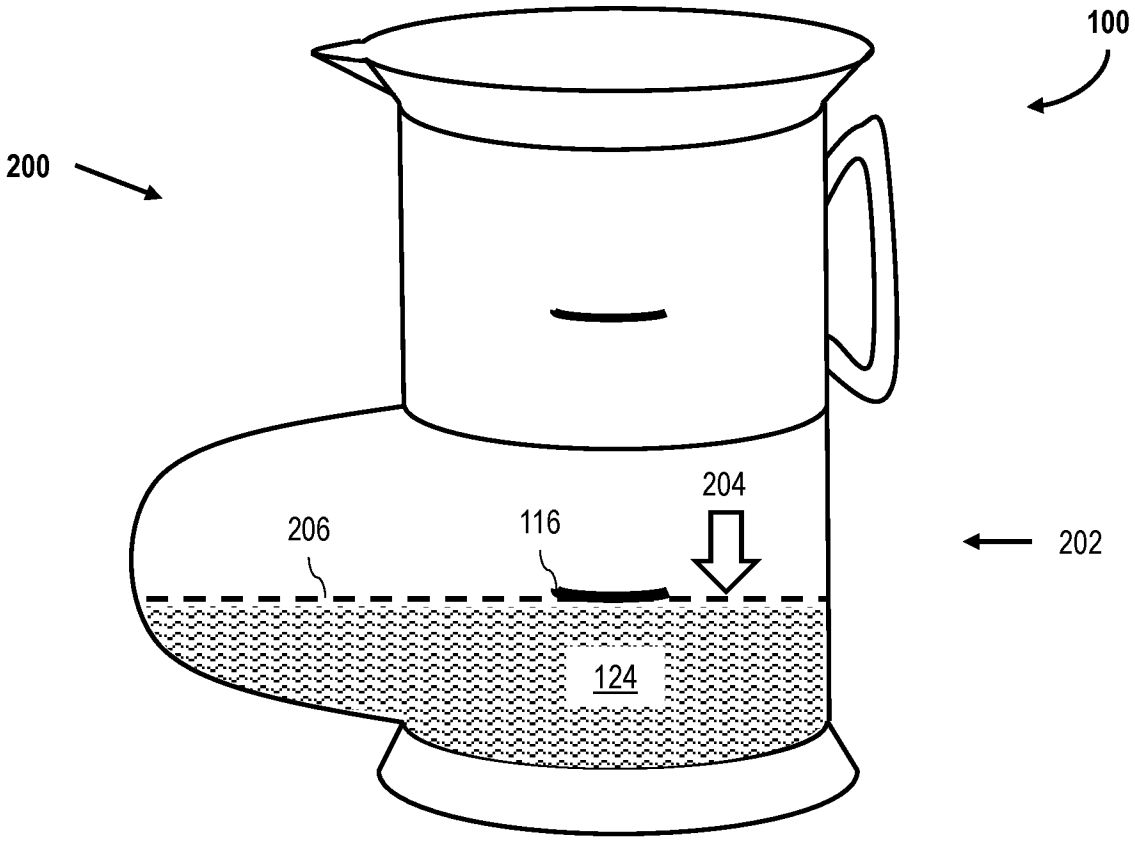
FIGS. 2A-D depict an operational series of the dispensing container depicted in FIG. 1.
Figure 3:
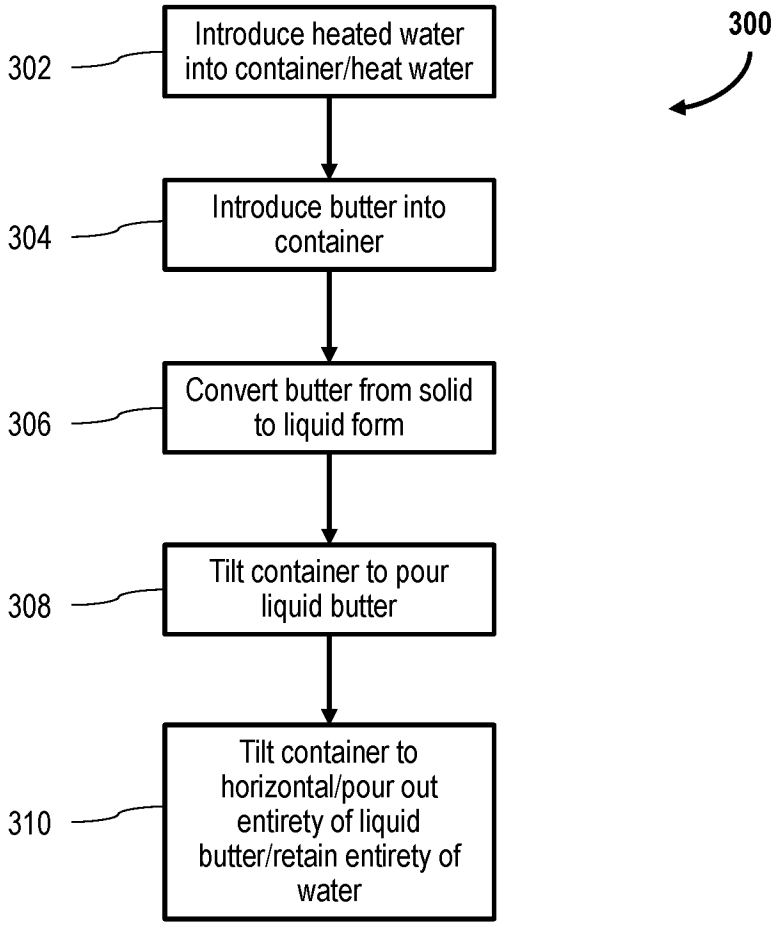
FIG. 3 is a flow diagram of an exemplary melting and dispensing process, according to an embodiment.

FIG. 2A depicts a first status 202 of container 100, in which a first liquid 204 is poured into container 100 up to fill line 116, such that an upper surface 206 of first liquid 204 substantially corresponds fill line 116 when container 100 is resting stably on a substantially flat surface as depicted. In as described further herein, first liquid 204 is referred to as "water" for ease of explanation, and to more conveniently describe the exemplary embodiment. In some embodiments, water 204 is heated (or boiled) prior to pouring into container 100. In other embodiments, water 204 is heated after filling container 100 up to fill line 116 (e.g., by a microwave oven, in the case where and overall height of container 100 is sufficiently low enough to allow clearance in a microwave oven).

Figure 2B:
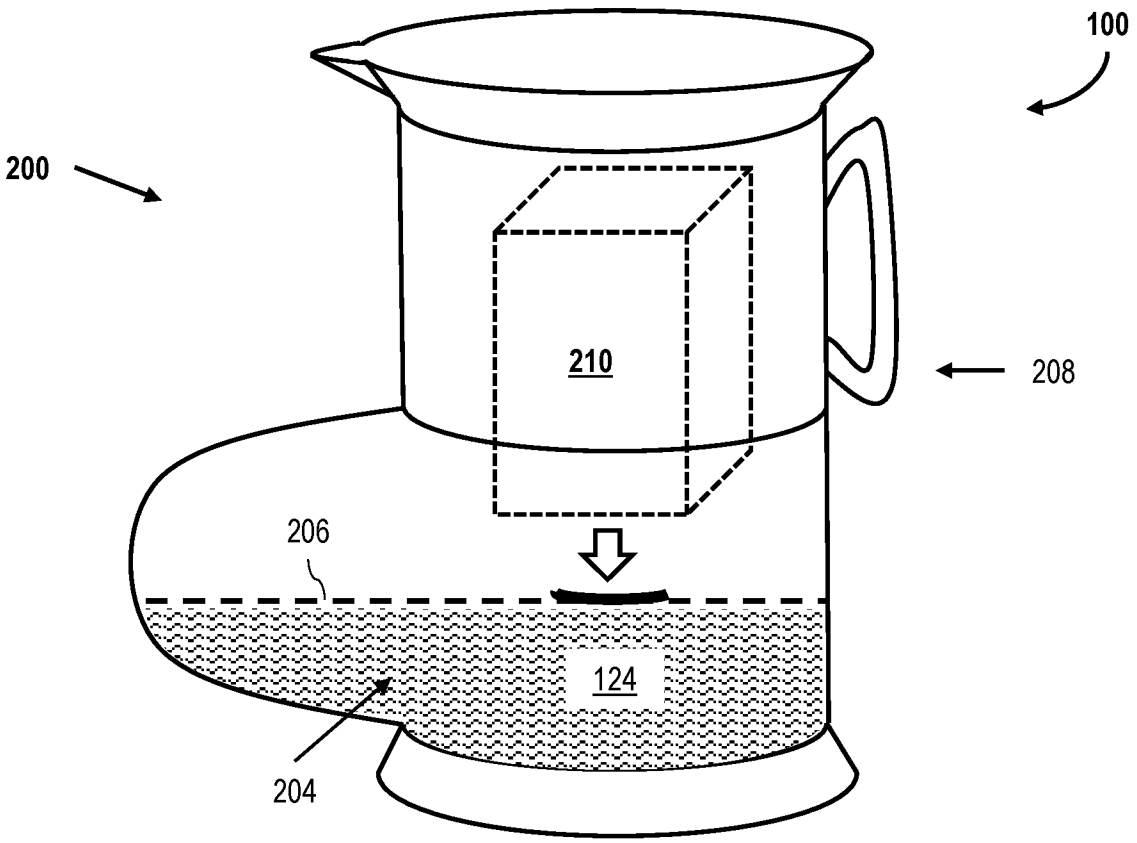

FIG. 2B depicts a second status 208 of container 100, in which a butter 210 is introduced within container 100. In the example illustrated in FIG. 2B, butter 210 is depicted as an actual stick of butter in solid form. Butter 210 may though, represent one or more water-insoluble fats that have a lower density than water 204, such that butter 210 will entirely float above upper surface 206 of water 204 when the two substances are co-mingled within container 100. Furthermore, in some embodiments, butter 210 may be heated and melted into liquid form prior to introduction (i.e., pouring) into container 100. Where butter 210 is introduced in solid form, the temperature of the heated water 204 will melt butter 210 into liquid form, or maintain butter 210 in liquid form, in the case where butter 210 is introduced to container 100 in liquid form, as depicted below with respect to FIG. 2C.

Figure 2C:
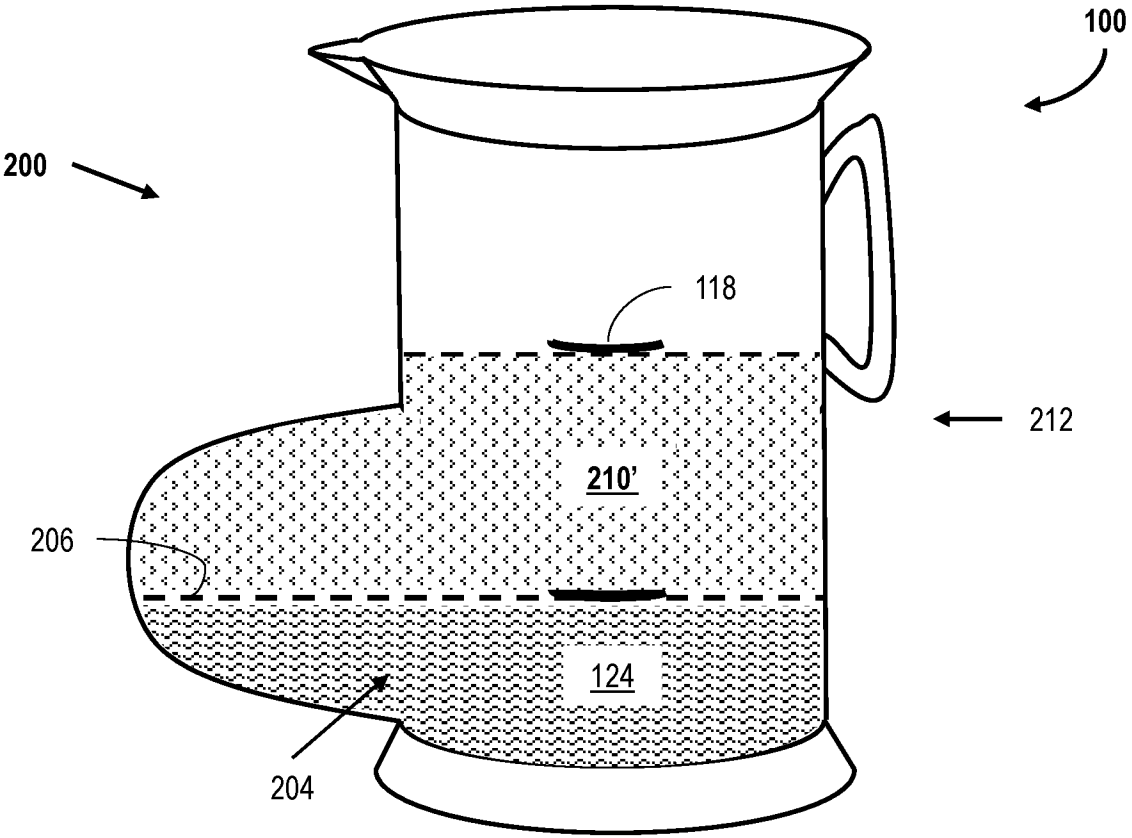

FIG. 2C depicts a third status 212 of container 100, in which butter 210 has been melted into a liquefied state, that is, liquid butter 210'. As illustrated in FIG. 2B, liquid butter 210', being non-soluble in water and having a lower density than water, floats entirely above upper water surface 206 within container 100. Additionally, while container 100 is maintained in the upright position shown, liquid butter 210' functions to provide an effective barrier between heated water 204 and the empty portion of container 100 above liquid butter 210'. Liquid butter 210' retains heat longer than water 204, and thus allows water 204 to stay heated longer within container 100 while liquid butter 210' forms the barrier. The present inventor has discovered that this technique typically allows liquid butter 210' to maintain the liquefied state from at least 2-4 hours without further reheating, depending on the initial temperature of water 204 when liquid butter 210' his first liquefied, the construction material of container 100, and the ambient temperature of the environment external to container 100.

In an exemplary embodiment of FIGS. 2B-C, butter 210 may be introduced in a sufficient quantity such that the combination of liquid butter 210' and water 204 within container 100 does not rise above at least one pouring indicator 118. In some embodiments, additional butter 210 may be introduced more than once until the combination of water 204 and liquid butter 210' rises to a desired pouring indicator 118.

Figure 2D:
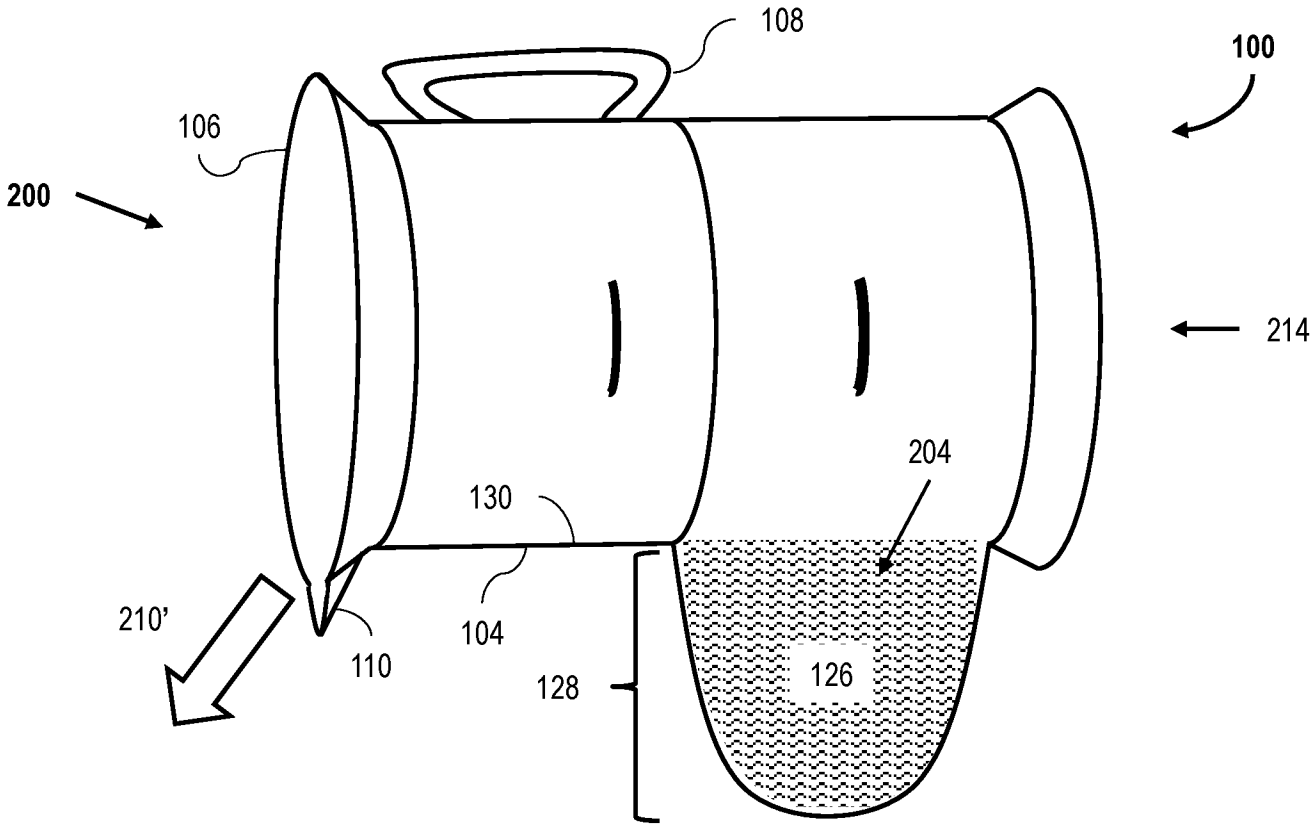

FIG. 2D depicts a fourth status 214 of container 100, in which container 100 is tilted (e.g., by gripping handle 108 and lifting container 100 from the resting upright position) to dispense liquid butter 210'. In the exemplary embodiment, the shape of neck portion 104 is substantially straight, such that liquid butter 210' easily flows across the inside of neck portion 104, along outer dimension 130, and out of pouring portion 106 and directional lip 110. In an alternative embodiment, pouring portion 106 is not above neck portion 104 with respect to main body portion 102, but is instead a directional spout (not shown) extending outwardly and upwardly from a mid-point (not numbered) of neck portion 104.

In further operation of fourth status 214, because liquid butter 210' will always float above water 204, liquid butter 210' will always be dispensed out of container 100 before any substantial quantity of water 204 can flow out. Because the typical consumer will not desire to dispense water upon the respective edible food item, catch sub-volume 126 thus functions, as depicted in FIG. 2D to catch and hold the volume of water 204 originally dispensed within container 100 (e.g., up to fill indicator 116) when container 100 is held in the horizontal position, that is, perpendicular to the upright position when container 100 is not in use. Thus, in the exemplary embodiment, catch sub-volume 126 is configured to be substantially equivalent to the volume of water 204 originally introduced into container 100 (FIG. 2A). In other words, when container 100 is held in the vertical position, upper surface 206 of water 204 substantially aligns with outer dimension 130 of neck portion 104. In the exemplary operation, therefore, this use of container 100 allows a consumer to dispense substantially the entire quantity of liquid butter 210' within container 100, but without substantially dispensing any of the quantity of water 204.

According to the systems and methods described herein, the physical properties of container 100 Allawi consumer to utilize either warm or hot water to melt the respective butter, and to also control the water-to-butter ratio within the container such that more or less butter may be maintained in the liquefied state as desired, or to control the relative density of butter coating an object inserted into container 100 (or into container 500, FIG. 5, below). The temperature of the water may be adjusted according to the desires of the user, or the circumstances of the actual use. Application of the present embodiments therefore provides distinct advantages over conventional systems that utilize water for heating purposes (i.e., a chafing dish), but keep the water separate from the butter. Such conventional systems are incapable of moderating or adjusting the temperature of the water; the water necessarily has the temperature of the respective heating source used in the conventional system.

FIG. 3 is a flow chart diagram of an exemplary butter melting and dispensing process 300, according to principles described above. In the exemplary embodiment, process 300 is executed in the order described below, but the person of ordinary skill in the art will appreciate, after reading and comprehending the present written description and accompanying drawings, that some steps may be performed simultaneously, or in the opposite order that follows. Other steps may be optional, but without departing from the inventive scope described herein.

In operation, process 300 begins at step 302. In step 302, water 204 is introduced into container 100. In exemplary operation of step 302, container 100 is in an upright, vertical position, and water 204 is heated prior to introduction into container 100. In alternative operation of step 302, water 204 is heated after introduction to container 100. In step 304, butter 210 is introduced into container 100, in direct contact with water 204 once within container 100. In an exemplary embodiment of step 304, butter 210 is in solid form, and water 204 is already heated, when butter 210 is introduced into container 100. In an alternative embodiment butter 210 is introduced into container 100 as liquid butter 210', thereby skipping step 306, and proceeding directly to step 308.

In step 306, the temperature of heated water 204 converts solid butter 210 into liquid butter 210'. In exemplary operation of step 306, liquid butter 210' is of sufficient volume to create a sealed barrier between heated water 204 and an empty volume within container 100 opposite liquid butter 210' with respect to water 204. In step 308, container 100 is lifted by handle 108 and tilted from the vertical direction, in the forward direction of directional lip 110, and liquid butter 210' flows through neck portion 104, and out of container 100 at directional lip 110. In step 310, container 100 is tilted all the way to the horizontal position, perpendicular to the upright vertical position, and substantially all of liquid butter 210' is dispensed from container 100, while substantially all of water 204 remains in container 100, that is, within forward sub-portion 128 and catch sub-volume 126.

Figure 4:
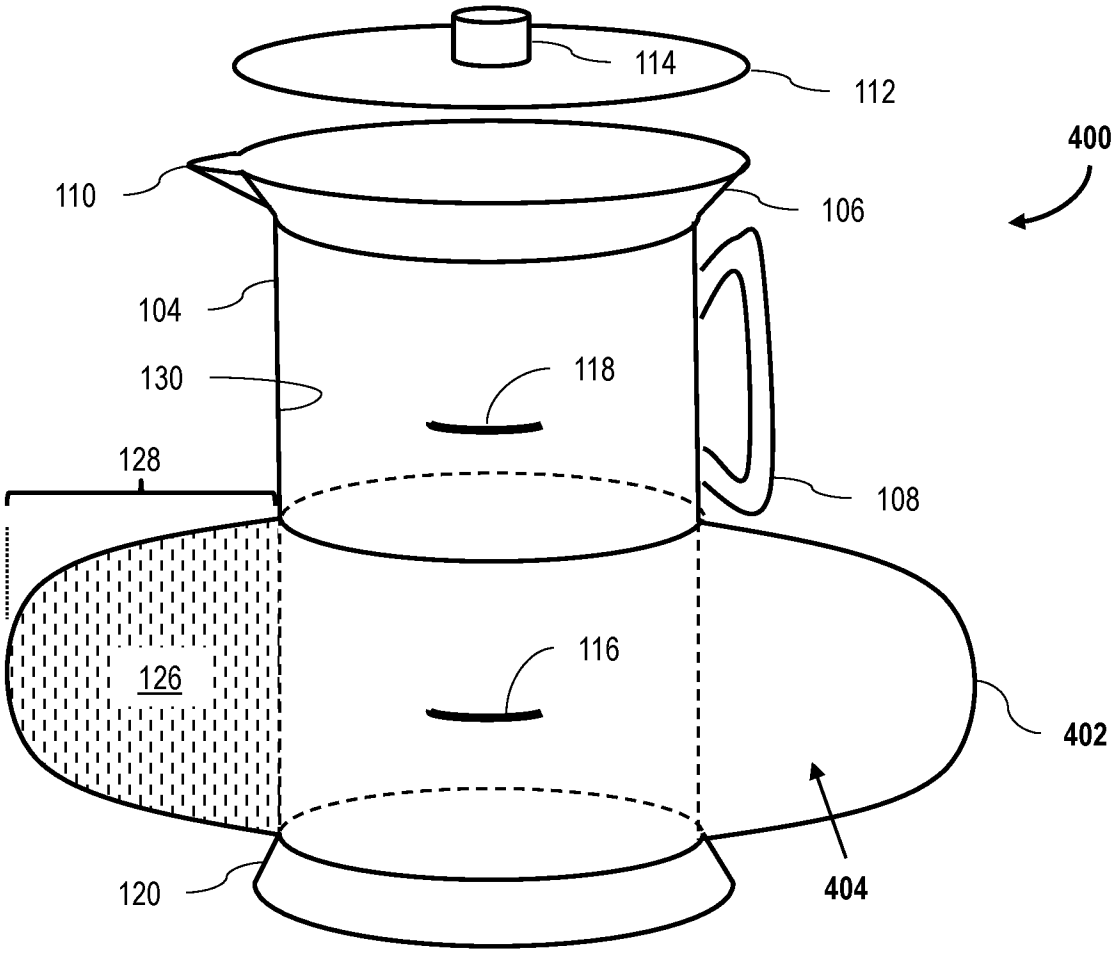
FIG. 4 depicts a sectional schematic illustration of an alternative dispensing container, according to an embodiment.

FIG. 4 depicts a sectional schematic illustration of an alternative dispensing container 400. Container 400 is similar to container 100, FIG. 1, except that container 400 includes the main body 402 having an extended sub-portion 404 beyond outer dimension 130 of neck portion 104, but in a different direction than forward sub-portion 128. This alternative dimensioning of main body 402 advantageously provides container 400 with the capability to have a more symmetrical, aesthetic overall outer shape, but without sacrificing any functionality of the principles described above. According to the alternative configuration of container 400, it will be appreciated that the overall shape of container 400 may be symmetrical (e.g., cylindrical, bulbed, box-like, etc.) or asymmetrical as desired. In this alternative embodiment, fill indicator 116 and/or pouring indicator(s) 118 would be disposed according to the respective volumes contained therein, and not according to the alternative outer shape. In at least one embodiment, the present inventor envisions that a constant internal shape and volume of container 400 may be maintained (i.e., the same as container 100, FIG. 1), while various sleeves or external coverings may be included on the outside of the respective container for purely non-functional reasons, that is, other than respective functional components such as the handle, lid, or base portion.

Figure 5:
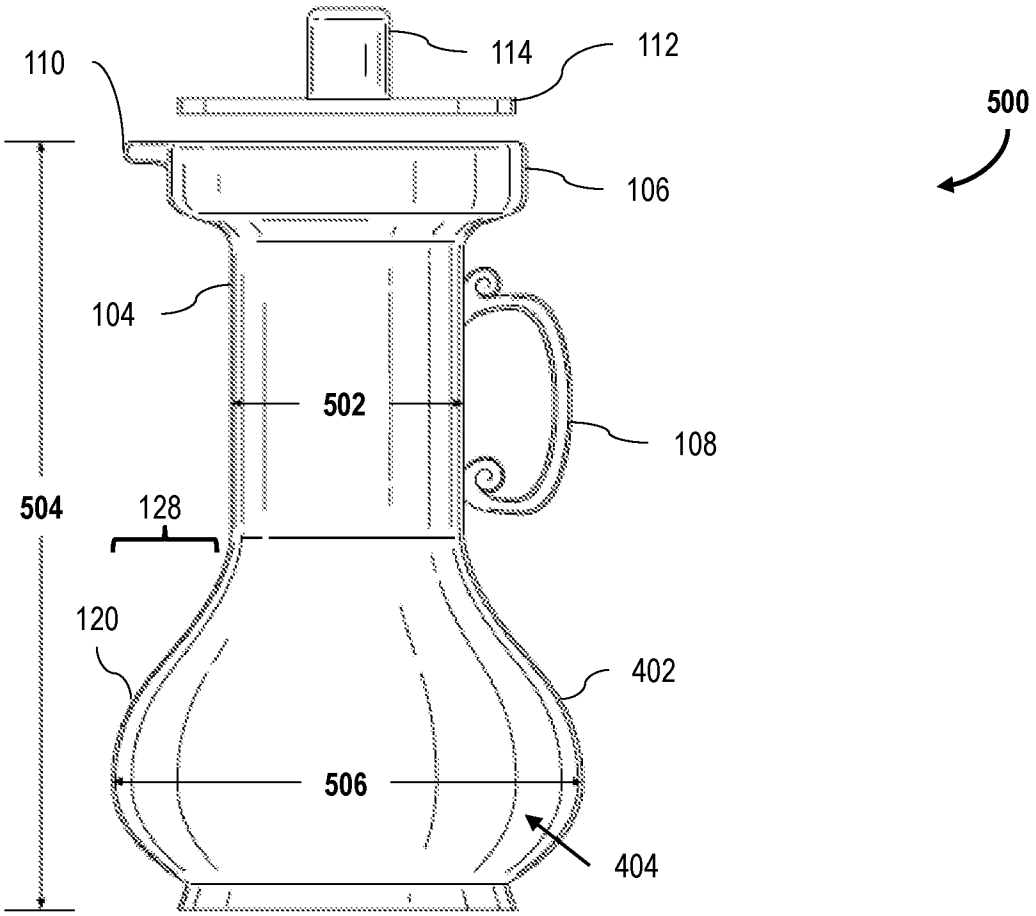
FIG. 5 depicts a side view schematic illustration of an alternative dispensing container, according to an embodiment.

FIG. 5 depicts a side view schematic illustration of an alternative dispensing container 500. Container 500 is similar to container 100, FIG. 1, and container 400, FIG. 4, except that container 500 is configured to include internal dimensions to accommodate entry therein of particular types of desired edible food items.

For example, in some instances, a consumer may further desire to utilize dispensing container 500 such that container 500 may also function as a dipping container, in addition to the dispensing functionality containers 100, 400, described above. Thus, in an exemplary embodiment of container 500, an internal diameter 502 of neck portion 104 may be sized sufficiently to accommodate, for example, an entire ear of corn. In this example, neck portion 104 is substantially cylindrical in shape, and internal diameter 502 is sized to be approximately 3.5 inches, but may range between 3 and 5 inches. Also in this exemplary embodiment, an overall height 504 of container 500 is approximately 12 inches, but may range between 10 inches and 15 inches. Further to this example, an internal width (or diameter, in the case of a symmetrical/cylindrical shape) of main body portion is, in an exemplary embodiment, approximately 6 inches, or nearly double the dimension of internal diameter 502 of neck portion 104. These dimensions may vary according to the desired use, but nevertheless I necessarily related to accomplish the same desired use. That is, as one dimension changes, the other respective dimensions will also change according to the principles described herein.

These particular dimensions allow container 500 to function as a dipping container for a standard ear of corn/corn cob, such that the ear of corn may be inserted almost entirely into container 500, but without being difficult to retrieve if, for example, dropped. In this example, fill indicator 116 and/or pouring indicator 118 are utilized to allow the consumer to dispense a sufficient quantity of water and butter into container 500, such that insertion of the entire ear of corn within container 500 will not cause the liquid contents therein to overflow outside of container 500 (i.e., in the upright position). In an exemplary embodiment, container 500 is configured to hold approximately 68 fluid ounces of liquid, with up to 48 ounces introduced to pouring indicator 118, such that 20 fluid ounces of liquid may be displaced without overflow of liquid from the device. In this exemplary configuration, container 500 may introduce between at least 2-8 ounces of butter or oil, or at least one standard stick of butter.

In exemplary operation of container 500, when an ear of corn is inserted, the butter, and not the water, coats the ear of corn as the corn presses through the barrier layer of butter floating above the water, even as the corn presses through the original upper surface of the water, and displaces the water to rise above this original upper surface height. The unique combination of water with a water-insoluble fat enables the food item to be decoded without being rinsed off by the water displaced within the interior of container 500. According to this advantageous configuration, the consumer may select the quantity of butter and water (e.g., according to fill indicator 116 and pouring indicator 118) such that the inserted corn cob item is coated with a thicker or thinner layer of butter as desired.

The person of ordinary skill in the art will thus appreciate, from this written description, that the overall size and individual dimensions of container 500 may be varied to accommodate the particular food item, as well as its size, and is not specifically limited according to the exemplary dimensions described above. The respective width and height of container 500 may, for example, be sufficiently large to accommodate one, two, three, or four corn cobs simultaneously (or greater), or in accordance with other types of edible food items, such as pieces of meat and/or vegetables of various shapes and sizes.

Figure 6B:
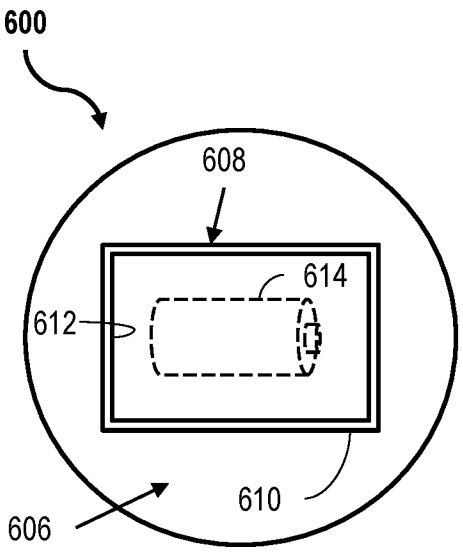
FIGS. 6A-B depict a cutaway schematic illustration of an alternative base portion for the dispensing container depicted in FIG. 1.
Figure 6A:
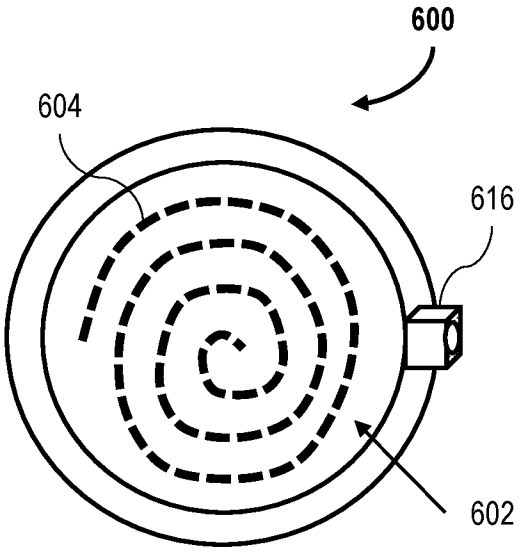

FIGS. 6A-B depict a cutaway schematic illustration of an alternative base portion 600 for dispensing container 100, FIG. 1, 400, FIG. 4, or 500, FIG. 5. In the exemplary embodiment, alternative base portion 600 functions as a warming device for the respective container. In this example, FIG. 6A represents the "top" view of a base portion 600, and FIG. 6B represents the "bottom" view of base portion 600, with respect to the relative dimensions described above.

In the exemplary embodiment, an upper surface 602 of base portion 600 includes a warming element 604 that enables upper surface 602 to function effectively as a hotplate for main body portion 102. Further in the exemplary embodiment, a bottom surface 606 of base portion 600 includes an opening 608 for providing and accessing a battery compartment 610 and a battery cover 612 for holding one or more batteries 614 therein to power warming element 604 in cooperation with sufficient electrical circuitry (not shown), such as is conventionally known. Alternatively, or additionally, the electrical circuitry includes an AC/DC converter (also not shown) for allowing warming element 604 to be powered directly by standard alternating current (and/or charge/recharge battery 614), and base portion 600 will include, in this example, a plug adapter or power jack 616 for receiving the AC power.

According to the advantageous systems and methods described herein, innovative structures and techniques are provided for conveniently melting butters in cooperation with heated water, maintaining the melted butter in liquefied form for substantial durations, and easily dispensing the liquid butter while restraining dispensing of the water within the container. The present embodiments accomplish conventional techniques of melting and dispensing butter, but through a greatly simplified structure that allow for easy cleaning and reuse. The simplified structure of the exemplary containers described above still further provide a device that may be mass-produced at relatively inexpensive cost in comparison to the conventional devices, but which will also realize the capability for multiple reuse due to the ease at which the device may be cleaned/sanitized, as well as a significantly longer product lifespan due to the lack of moving and electrical parts in the overall structure.

The butter melting/dispensing techniques for the container structures described herein are of particular advantageous use using only warm or hot water mixed with a selected edible fat, such as butter, margarine, coconut oil, solidifying olive oil, etc. The present embodiments are also useful for containing and dispensing other edible oils that may typically be in liquid form at room temperature, but for which a convenient and sanitary dispenser is also desired. Furthermore, the container and related methods of use described above are particularly advantageous over conventional systems and techniques, in that the present embodiments may be directly applicable where more than one type of water-insoluble edible fat are included simultaneously within the container. That is, present containers and their associated methods of use may simultaneously melt, contain, and dispense a mixture of one or more edible fats, but still using only water as the melting medium. The "butter" of the embodiments described above may be, for example, a blend of one or more oils, butters, margarines, etc., but without departing from the scope of the innovative principles described herein.

According to the innovative structures and techniques herein, the ability of the consumer to more easily melt, transport, and or dispense liquid butters is significantly improved in comparison with conventional butter-melting techniques and devices. The several techniques of the embodiments disclosed herein are further advantageous in that they may be fully implemented with all water-insoluble edible fats having lower density than water, including mixed blends of such fats and oils. The examples described above are generally confined, for ease of explanation, to cases where the two heated liquids in the containers are butter and water. In practice though, the innovative systems and methods herein are applicable to all edible liquids having different densities, and where at least one of the liquids is insoluble with respect to another liquid.

Exemplary embodiments of liquefied edible fat dispensing systems and methods are described above in detail, as well as exemplary systems and methods for maintaining the edible fat in liquid form for significant durations. The systems and methods of this disclosure though, are not limited to only the specific embodiments described herein, but rather, the components and/or steps of their implementation may be utilized independently and separately from other components and/or steps described herein.

Although specific features of various embodiments of the disclosure may be shown in some drawings and not in others, this convention is for convenience purposes and ease of description only. In accordance with the principles of the disclosure, a particular feature shown in a drawing may be referenced and/or claimed in combination with features of the other drawings.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container for dispensing at least one liquid water-insoluble edible fat, comprising: a main body portion containing therein a body volume and a fill sub-volume within a first region of the main body portion, wherein the fill sub-volume is less than the body volume; a pouring portion configured to direct a flow of the at least one liquid water-insoluble edible fat which is insoluble over water or polar liquid out of the container when the container is tilted off of a vertical axis; and a neck portion connecting the main body portion to the pouring portion, the neck portion having a neck width less than a width of the main body portion in a first direction, wherein the main body volume is configured to further include a catch sub-volume within a second region of the main body portion extending beyond the neck width in the first direction, wherein the second region is different than the first region, and wherein the catch sub-volume is substantially equal to the fill sub-volume; and wherein the catch sub-volume is defined by a protrusion that extends from a cylindrical side wall of the main body portion and the protrusion extends in a horizontal direction, wherein the protrusion is asymmetrical with respect to a central axis of the main body portion.

2. The container of claim 1, further comprising a fill indicator on an exterior of the container.

3. The container of claim 2, wherein the first region comprises a first section of the main body portion below the fill indicator.

4. The container of claim 3, wherein the at least one liquid water-insoluble edible fat comprises one or more of butter, margarine, coconut oil, and olive oil.

5. The container of claim 4, wherein the container is configured to hold a quantity of heated water within the first region up to the fill indicator.

6. The container of claim 3, wherein the fill indicator comprises one of a viewable marking, a temperature sensitive coating or label, a transparent window, and one or both of a hydrophilic and hydrophobic substance.

7. The container of claim 1, wherein the container is formed of one or more of glass, plastic, and metal.

8. The container of claim 7, wherein the container comprises a double-walled vacuum insulation construction.

9. The container of claim 7, wherein the container is configured for disassembly and reassembly of the main body portion with respect to the neck portion.

10. The container of claim 1, wherein the pouring portion comprises a directional lip.

11. The container of claim 10, further comprising a handle disposed on the container opposite the directional lip.

12. The container of claim 10, further comprising a removable lid configured to integrally mate with the pouring portion.

13. The container of claim 12, wherein the removable lid is configured to integrally mate with the pouring portion by a snap lock.

14. The container of claim 12, wherein the removable lid is configured to integrally mate with the pouring portion by a twist and seal mechanism.

15. The container of claim 14, wherein the twist and seal mechanism comprises a first position configured to completely seal the at least one liquid water-insoluble edible fat within the container and a second position configured to allow the at least one liquid water-insoluble edible fat to exit the container through the directional lip.

16. The container of claim 1, further comprising a base portion integral with the main body portion.

17. The container of claim 16, wherein the base portion comprises an electrical warming element and means for powering the electrical warming element.

18. A method for liquefying and dispensing at least one water-insoluble edible fat, the method comprising the steps of: introducing a volume of water into a first portion of container; adding, into the container, the at least one water-insoluble edible fat in solid form; heating the volume of water to a temperature sufficient to melt the at least one water-insoluble edible fat which is insoluble over the water; tilting, after step of heating, the container from a vertical position to pour out of the container a liquefied quantity of the at least one water-insoluble edible fat; and catching, during the step of tilting, the volume of water within a second portion of the container, smaller than the first portion, configured to prevent the volume of water from exiting the container when the container is tilted to a horizontal position perpendicular to the vertical position; and wherein a catch sub-volume is defined by a protrusion that extends from a cylindrical side wall of a main body portion and the protrusion extends in a horizontal direction, wherein the protrusion is asymmetrical with respect to a central axis of the main body portion.

19. The method of claim 18, wherein the step of heating is performed prior to the step of introducing.

20. The method of claim 18, wherein the step of heating is performed prior to the step of adding.

* * * * *